US008062602B2

(12) United States Patent
Roe et al.

(10) Patent No.: US 8,062,602 B2
(45) Date of Patent: Nov. 22, 2011

(54) CATALYST HOUSING

(75) Inventors: Thomas Roe, Stoughton, WI (US); David Kapsos, McFarland, WI (US); Jay Warner, Stoughton, WI (US); Roger Bahr, Boscobel, WI (US); John Degnan, Wauzeka, WI (US); Dawn Marsh, Stoughton, WI (US); Ken Trumm, Muscoda, WI (US)

(73) Assignee: Universal Acoustic & Emission Technologies, Inc., Stoughton, WI (US)

( * ) Notice: Subject to any disclaimer, the term of this patent is extended or adjusted under 35 U.S.C. 154(b) by 202 days.

(21) Appl. No.: 12/616,677

(22) Filed: Nov. 11, 2009

(65) Prior Publication Data

US 2010/0129270 A1 May 27, 2010

Related U.S. Application Data

(60) Provisional application No. 61/117,855, filed on Nov. 25, 2008.

(51) Int. Cl.
*B01D 50/00* (2006.01)

(52) U.S. Cl. ..... 422/179; 422/180

(58) Field of Classification Search ..... 422/177, 422/179, 180
See application file for complete search history.

(56) References Cited

U.S. PATENT DOCUMENTS

| | | | | |
|---|---|---|---|---|
| 4,843,815 | A * | 7/1989 | Smojver | 60/299 |
| 5,169,604 | A * | 12/1992 | Crothers, Jr. | 422/177 |
| 5,746,986 | A * | 5/1998 | Pollock et al. | 422/177 |
| 7,157,060 | B1 | 1/2007 | Newburry | |
| 7,410,621 | B2 * | 8/2008 | Muter et al. | 422/180 |
| 7,919,052 | B2 * | 4/2011 | Ahmed | 422/179 |
| 2002/0141910 | A1 | 10/2002 | Adiletta | |
| 2005/0056008 | A1 | 3/2005 | Endo | |
| 2009/0025376 | A1 | 1/2009 | Ahmed | |

FOREIGN PATENT DOCUMENTS

EP 2 110 528 A1 10/2009

OTHER PUBLICATIONS

U.K. Search Report for corresponding patent application GB 0920503.0 dated Mar. 8, 2010.

* cited by examiner

*Primary Examiner* — Tom Duong
(74) *Attorney, Agent, or Firm* — Andrus, Sceales, Starke & Sawall, LLP

(57) ABSTRACT

Catalyst housings and catalyst silencer housings that include various features for modularity and for servicing and securing catalysts elements, spacers and filter elements are provided.

23 Claims, 12 Drawing Sheets

CATALYST HOUSING

CROSS REFERENCE TO RELATED APPLICATION

This application relates to and claims priority from pending U.S. Provisional Patent Application No. 61/117,855, which is incorporated herein by reference.

FIELD

The present application discloses catalyst housings and catalyst silencer housings that include various features for modularity and for servicing and securing catalyst elements, spacers and filter elements.

DETAILED DESCRIPTION OF THE DRAWINGS

Figure 1:
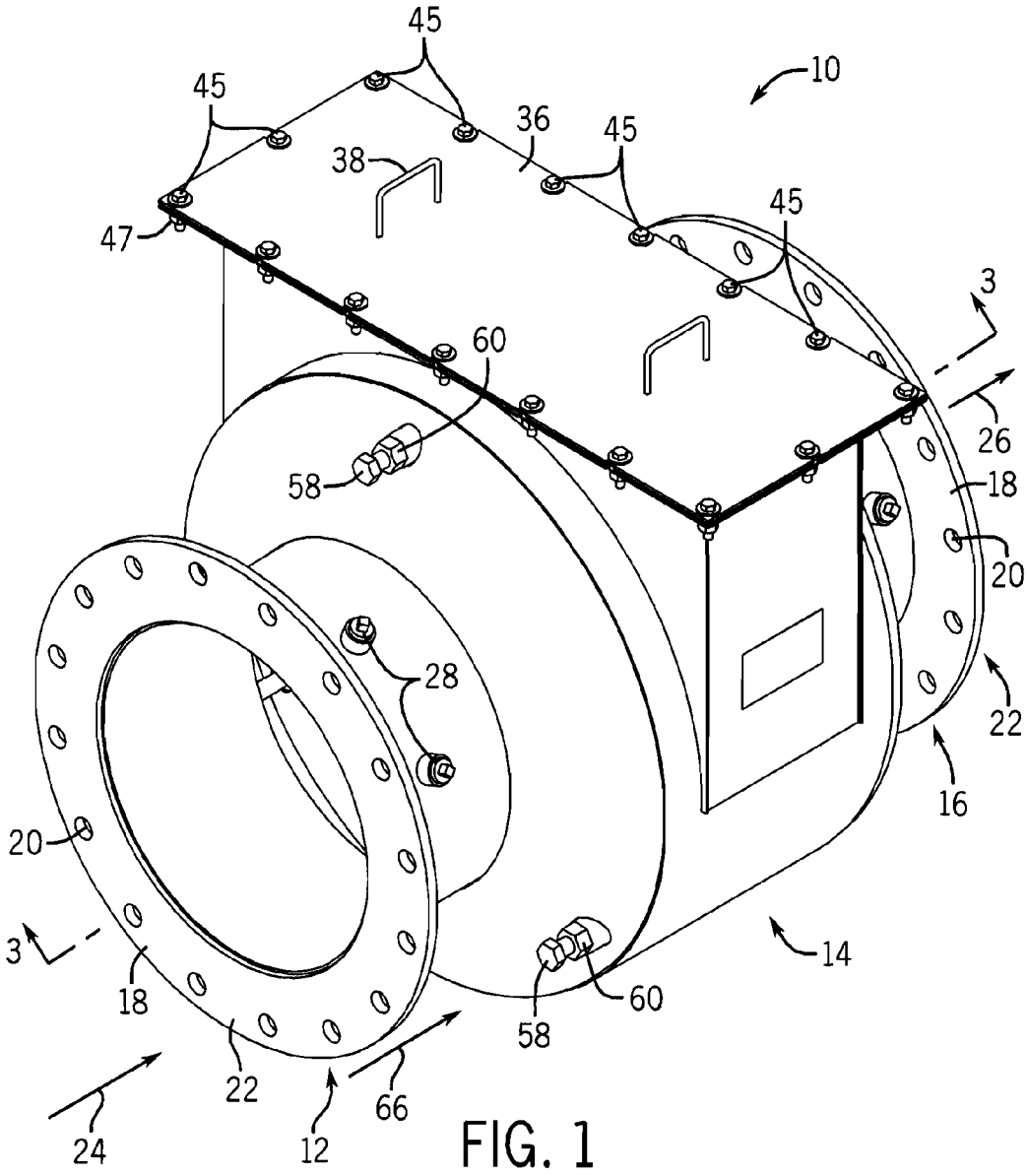
FIG. 1 is a perspective view of one example of a catalyst housing according to the present disclosure.
Figure 2:
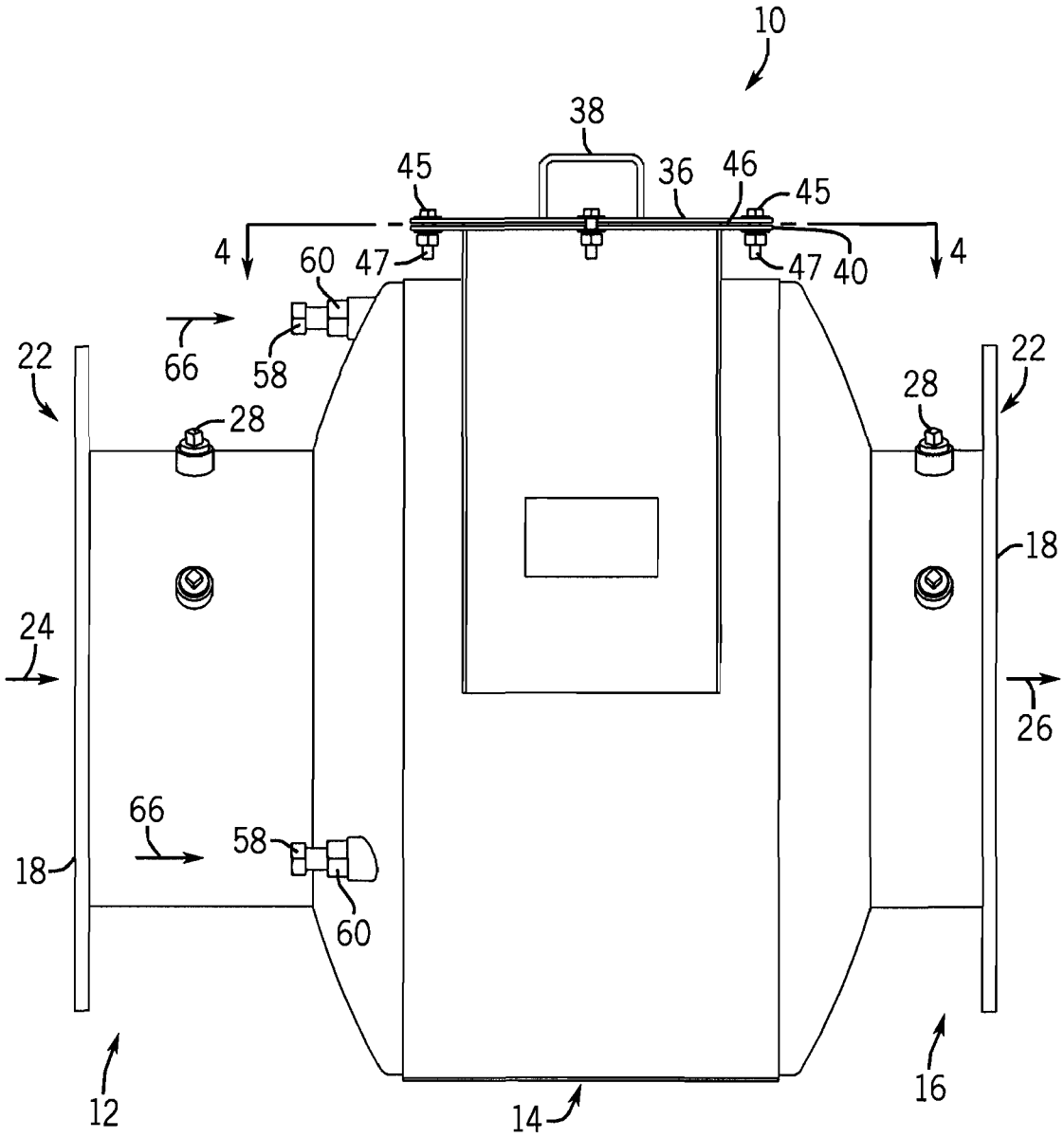
FIG. 2 is a side view of the catalyst housing in FIG. 1.

In the present disclosure, certain terms have been used for brevity, clearness, and understanding. No unnecessary limitations are to be implied therefrom beyond the requirement of the prior art because such terms are used for descriptive purposes only and are intended to be broadly construed. The different apparatuses and method steps described herein may be used alone or in combination with other apparatuses and method steps. It is to be expected that various equivalents, alternatives and modifications are possible.

FIGS. 1-7 depict one example of a catalyst housing 10 according to the present disclosure. The catalyst housing 10 includes an exhaust gas inlet 12, a housing body 14, and an exhaust gas outlet 16. The inlet 12 and outlet 16 both have mating flanges 18 for connection to an upstream source of exhaust gas and downstream conventional equipment, respectively. Each of the flanges has a plurality of apertures 20 for receiving securing mechanisms, such as screws, for attachment to the upstream and downstream equipment. The flanges 18 both have outer sealing faces 22 for sealing with said equipment.

The inlet 12 and outlet 16 are shown as cylindrical tubes, however, any other shape suitable for conveying exhaust gas from upstream to downstream along the direction of arrows 24, 26 can suffice. The inlet 12 and outlet 16 include sensor ports 28 for conventional temperature sensors, back pressure sensors, oxygen sensors, and/or the like for measuring characteristics of inlet exhaust gas and outlet exhaust gas. In an alternative arrangement, the sensor ports 28 could be located on or in the housing body 14.

The housing body 14 encloses a flow dispersion device 30 (FIG. 3), which in the example shown is a perforated plate through which exhaust gas flows. A pair of catalyst members including a downstream primary catalyst 32 and an upstream secondary catalyst 34 is aligned in series downstream of the flow dispersion device 30 and upstream of the outlet 16. In an alternate embodiment, the primary catalyst 32 or secondary catalyst 34 could be replaced with a spacer, as will be described further below. In a further alternate embodiment, the primary catalyst 32 or secondary catalyst 34 could be replaced with a filter element, as will be described further below.

The catalysts 32, 34 are circular in cross section, however the housing 10 could be designed to accommodate catalysts having various other shapes and sizes. The particular example shown is designed to removably contain two catalysts. However, it will be recognized that the housing 10 could be designed to removably contain one or three or more catalysts. Suitable insulation can also be disposed in the housing body 14 and around the catalysts 32, 34.

An access door 36 is provided on the housing body 14 and in the example shown is a flat panel having a handle 38. The access door 36 is attached to the housing body 14 in a sealed, removable manner. In the example shown, the access door 36 is removably attached to a flange surface 40 on the housing 14. The access door 36 and flange surface 40 both have a series of slots 42 and holes 44 that are aligned when the access door 36 is properly mated with the flange surface 40. The slots 42 are open at the outer edges of the access door 36 and flange surface 40. A series of bolt 45 connections are fed through the aligned slots 42 and holes 44 and tightened to connect the access door 36 and flange surface 40 in a sealed manner. In the preferred arrangement, a gasket seal 46 is sandwiched between the mated surfaces of the access door 36 and flange surface 40 to prevent exhaust gas escape from inside of the housing body 14. The bolt 45 connections in the slots 42 facilitate an easy removal of door hardware. That is, it is only necessary to loosen the bolts 45 and associated nuts 47 and slide the same outwardly out of the open end of the slots 42 without completely separating the bolts 45 from the nuts 47. The bolt 45 connections in the holes 44 provide stability to the mated connection. In another alternative embodiment, clamps could be used to facilitate a stable connection with easy separation of the access door 36 from the flange surface 40. The access door arrangement thus provides a flat sealing interface that is less subject to breakdown, thus resulting in less external leakage of exhaust gas. The durable arrangement of the access door 36 connection to the housing body 14 provides easy access to remove and repair or replace the catalysts 32, 34 during the operational life of the housing 10.

Each catalyst 32, 34 includes a catalyst body 48 surrounded by a sleeve 50 or cylinder of sheet metal. Each catalyst 32, 34 aligns with the other catalyst to form a sealing interface preventing escape of exhaust gas radially outwardly towards, for example, the access door 36. This can be accomplished by different sealing arrangements. In the example shown, upstream and downstream rings 52, 54 are welded onto the catalyst such as onto the sleeve 50. The catalysts 32, 34 are inserted into the body 14 via the access door 36 and aligned such that the downstream ring 54 on the secondary catalyst 34 aligns with the upstream ring 52 on the primary catalyst 32 so as to form a mating (sealing) surface therebetween. In one example, a sealing gasket 53 is sandwiched between the mated surfaces of the rings 52, 54. In addition, the downstream ring 54 of the primary catalyst 32 mates with a sealing surface 56 on the inside of the housing body 14. A sealing gasket 53 can be sandwiched between the mated surfaces 54, 56. Alternative arrangements can be employed to achieve the noted sealing function. For example, upstream and downstream sealing mechanisms on each catalyst 32, 34 can include structural features (not shown) to create a tortuous flow path to hinder the escape of exhaust gas radially outwardly away from the catalysts 32, 34.

Figure 3:
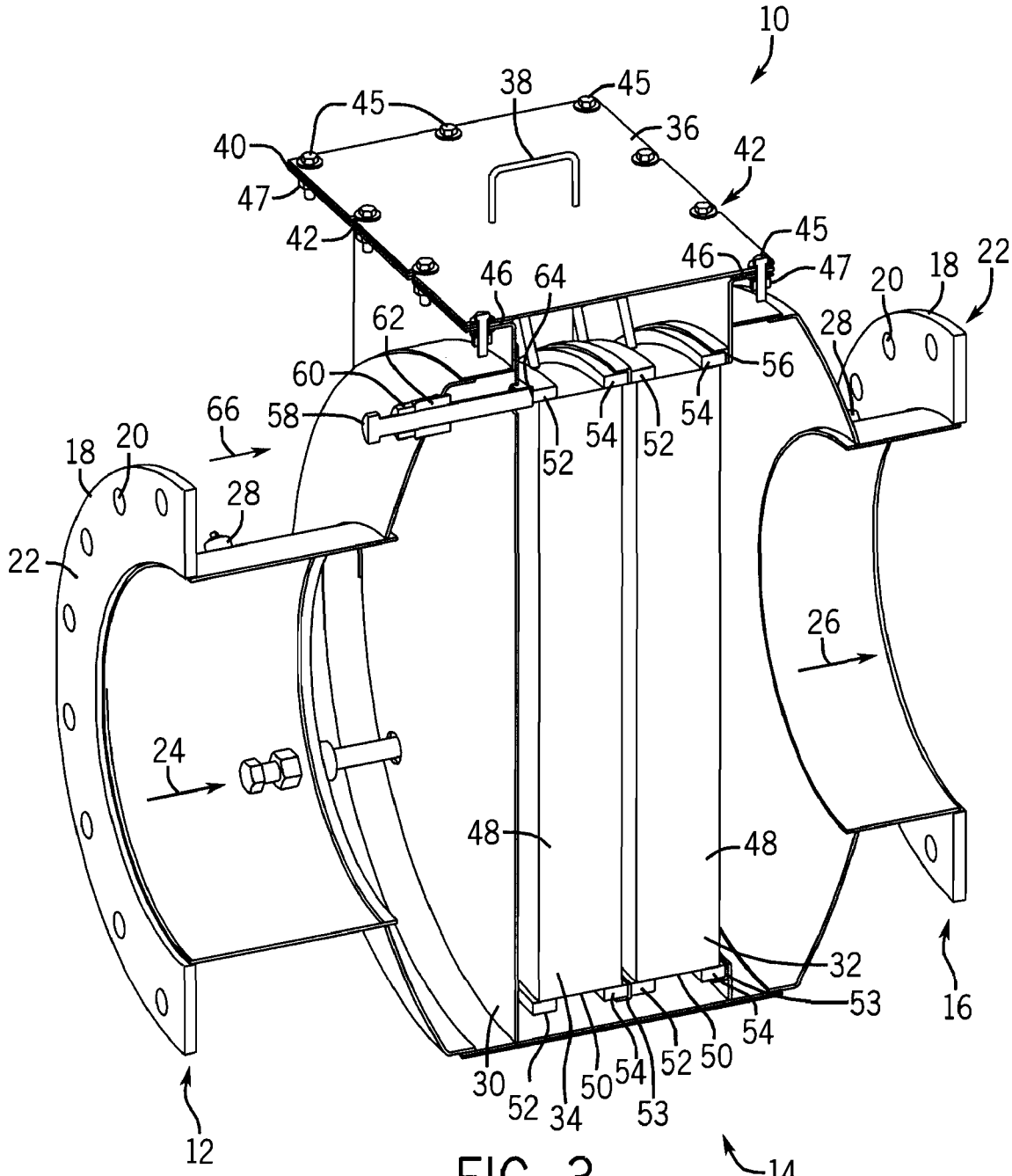
FIG. 3 is a perspective sectional view taken along section line 3-3 in FIG. 1.
Figure 4:
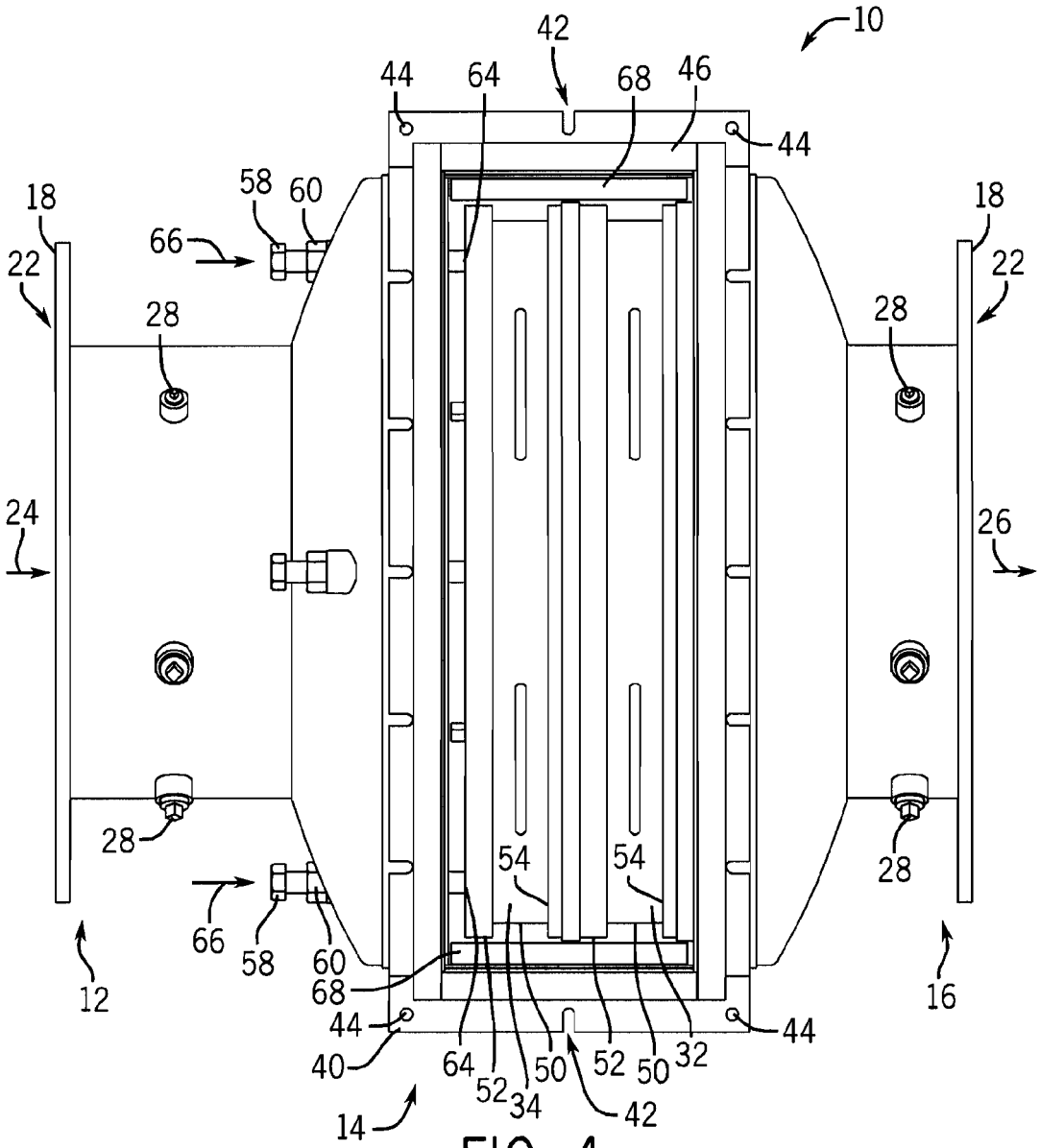
FIG. 4 is a top view of the catalyst housing in FIG. 1, having a flat panel cover removed.
Figure 5A:
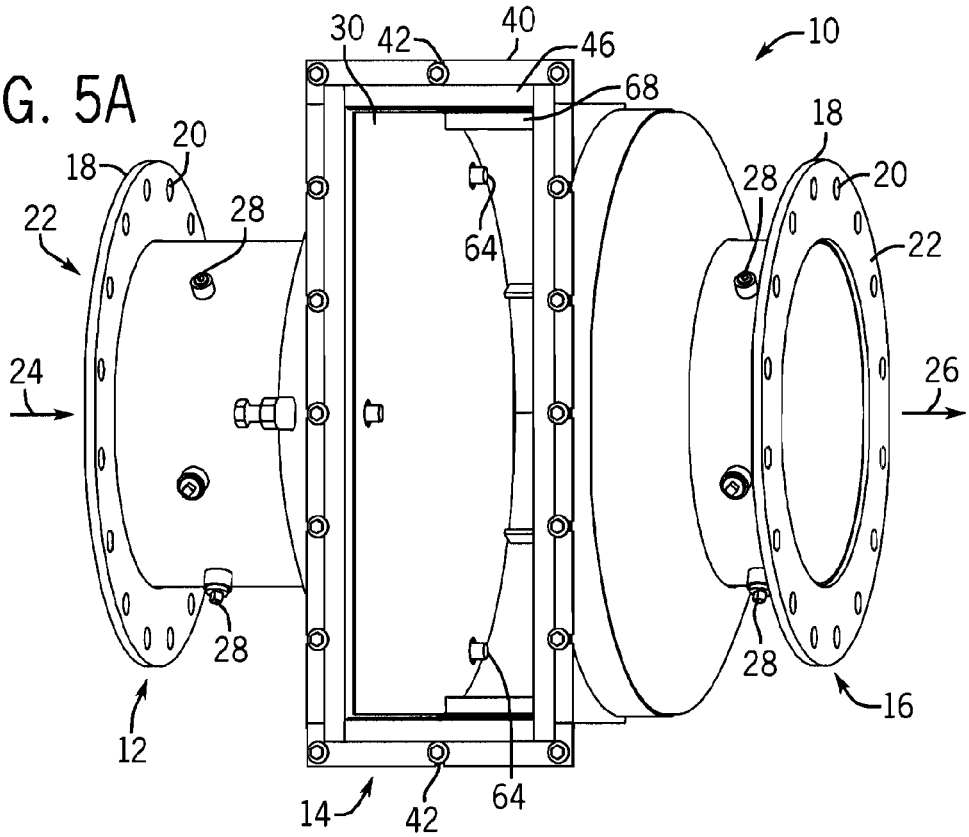
FIGS. 5A and 5B are perspective views of the catalyst housing in FIG. 1.
Figure 5B:
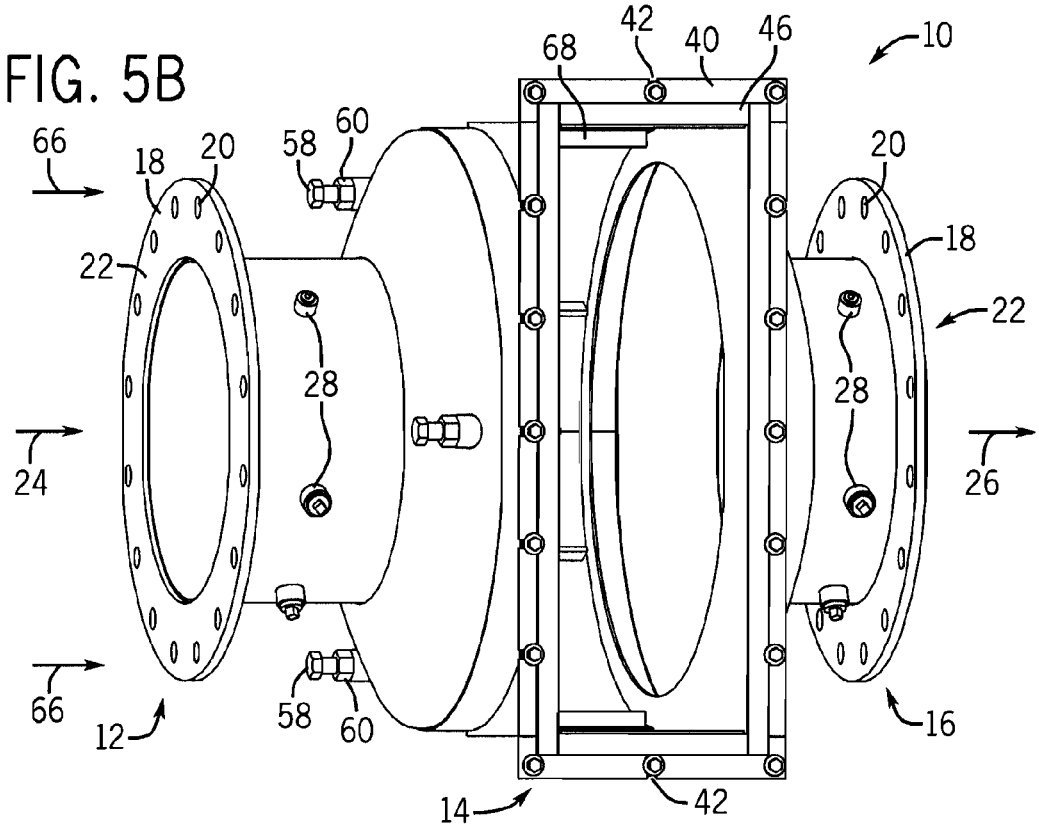
Figure 6:
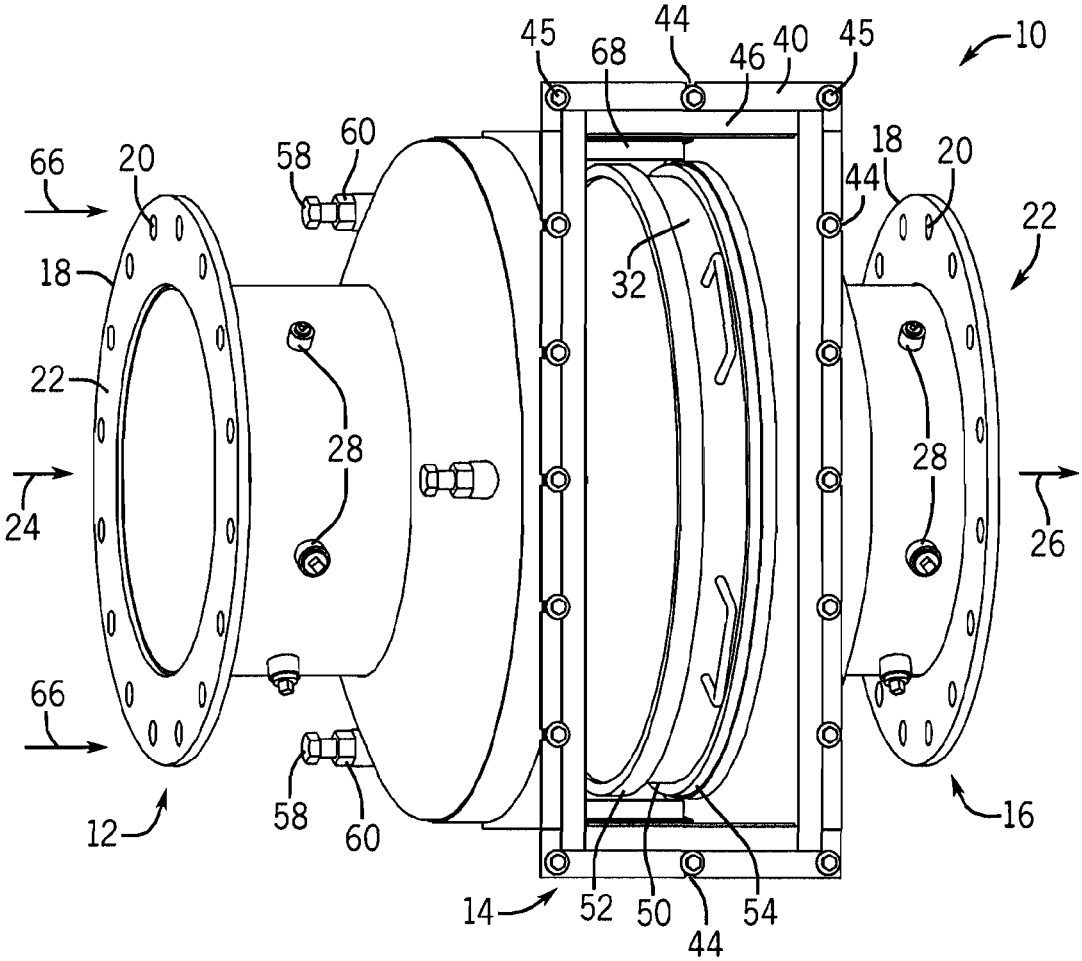
FIG. 6 is a top view of the catalyst housing in FIG. 1 showing a catalyst in the catalyst housing.
Figure 7:
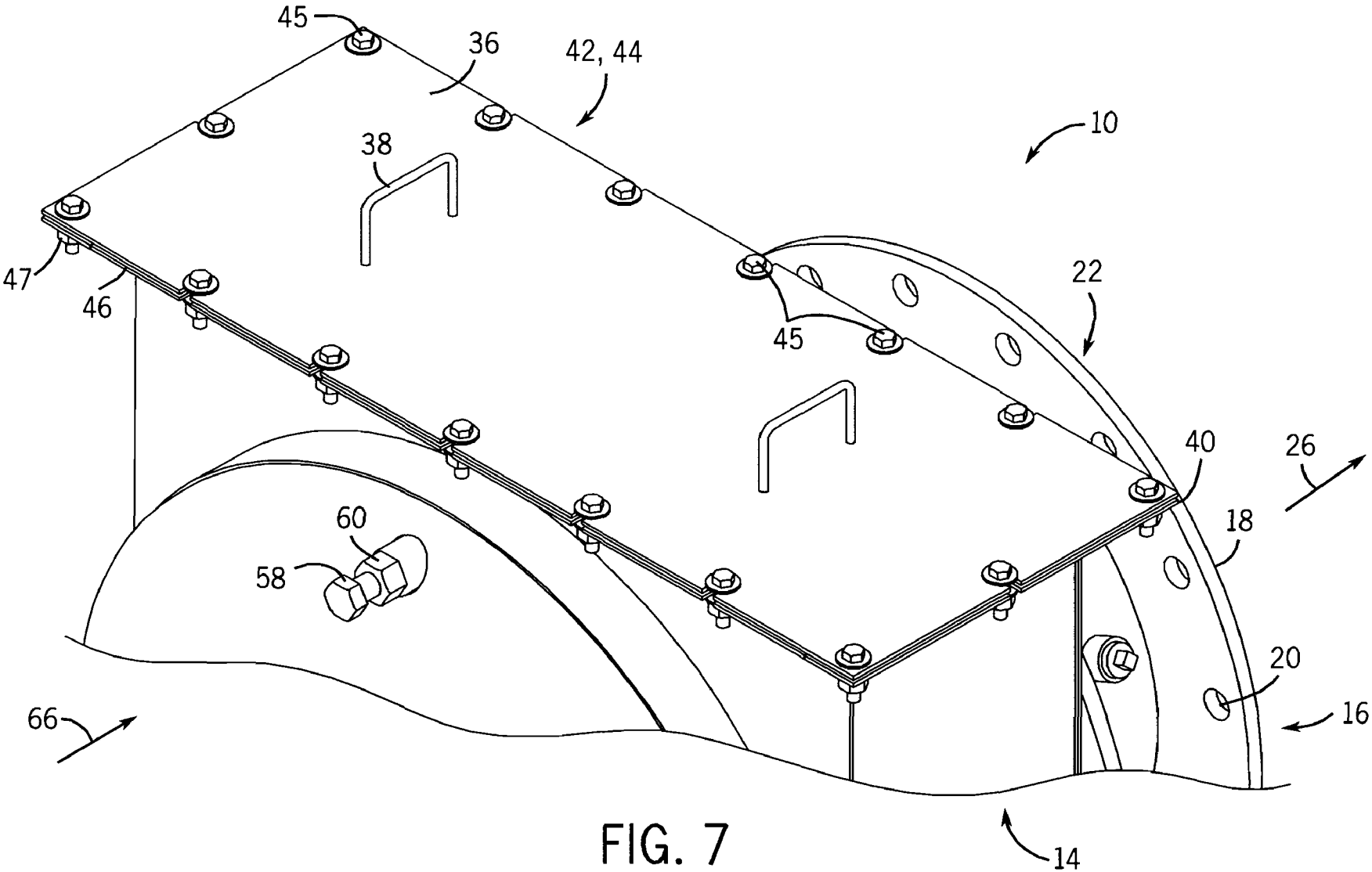
FIG. 7 is a perspective view showing a flat panel cover on the catalyst housing.

A plurality of catalyst retention bolts 58 and associated jamb nuts 60 are provided in an external surface of the housing body 14. In the example shown, the retention bolts 58 and associated jamb nuts 60 are provided on the upstream end or inlet end of the housing body 14, however in an alternative arrangement, could be provided on the downstream end or outlet end of the housing body 14. In the example shown, three retention bolts 58 and associated jamb nuts 60 are provided, however any number of these devices could be utilized to promote effective sealing within the housing 10 as herein described. The retention bolts 58 connect to the housing body 14 via a threaded connection 62 in such a manner that the distal end 64 of each retention bolt 58 engages with the upstream ring 52 on the secondary catalyst 34 and applies an axial force along the direction of arrow 66 (FIG. 3). As the retention bolt 58 is torqued down on the housing body 14 via the threaded connection 62 axial force is applied to the upstream ring 52, then to the sleeve 50, onto the downstream ring 54 of the secondary catalyst 34. The axial force is then transferred from the downstream ring 54 of the secondary catalyst 34 to the sleeve 50, upstream ring 52 of the primary catalyst 32, to the sleeve 50 of the primary catalyst 32, and onto the downstream ring 54 of the primary catalyst 32. The force is then transferred to the sealing surface 56 of the housing body 14. The axial force promotes sealing and catalyst retention between the respective rings 52, 54 and the ring 54 and sealing surface 56. Additionally, gaskets 53 preferably provided between such sealing surfaces further promote sealing and prevent escape of exhaust gas.

Catalyst alignment features are provided in the housing body 14 to promote alignment of the respective catalysts 32, 34 and alignments of the associated upstream and downstream rings 52, 54. In the example shown, the alignment features include a plurality of lateral ribs 68 extending axially inside the housing body 14. These ribs can consist of, for example, steel spacer bars.

It will thus be understood that the catalysts 32, 34 are easily removed and replaced within the housing body 14 via the access door 36. Alternatively, it is possible to use only a single catalyst with an associated spacer device that is shaped like a catalyst. Although the example shows two catalysts aligned side by side, it is possible to construct a housing body 14 capable of holding only one catalyst element, or three or more catalyst elements in series. Alternatively, it is also possible to use only a single catalyst with an associated filter element, shaped like a catalyst. Although the example shows two catalysts aligned side by side, it is possible to construct a housing body 14 capable of holding a larger number of catalysts, spacers, and filter elements in combination.

The catalyst housing 10 provides an improved modular device having high quality preventative leak performance characteristics to, for example, minimize exhaust gas leakage and/or bypass of the catalyst units. The example shown is suitable for use in robust, high horsepower systems, but can also be used in relative simple, low horsepower systems.

Figure 8:
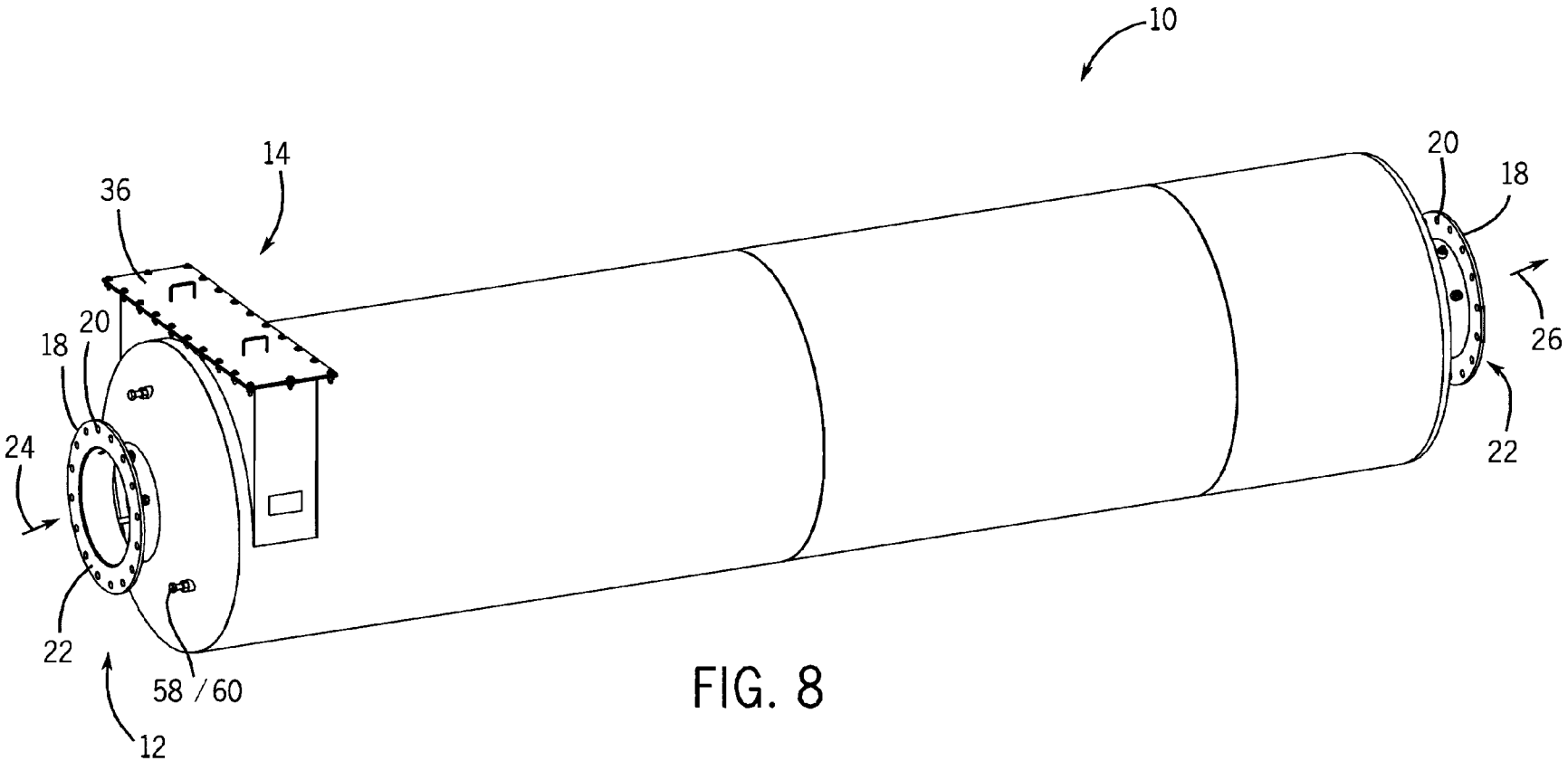
FIG. 8 is a perspective view of a catalyst housing in an end-in, end-out catalyst and silencer housing configuration.

FIG. 8 shows an end-in, end-out catalyst and silencer housing. The housing 14 is located at the inlet side of the silencer. In an alternative arrangement, housing 14 can be located elsewhere on the silencer, such as at the outlet side of the silencer.

Figure 9:
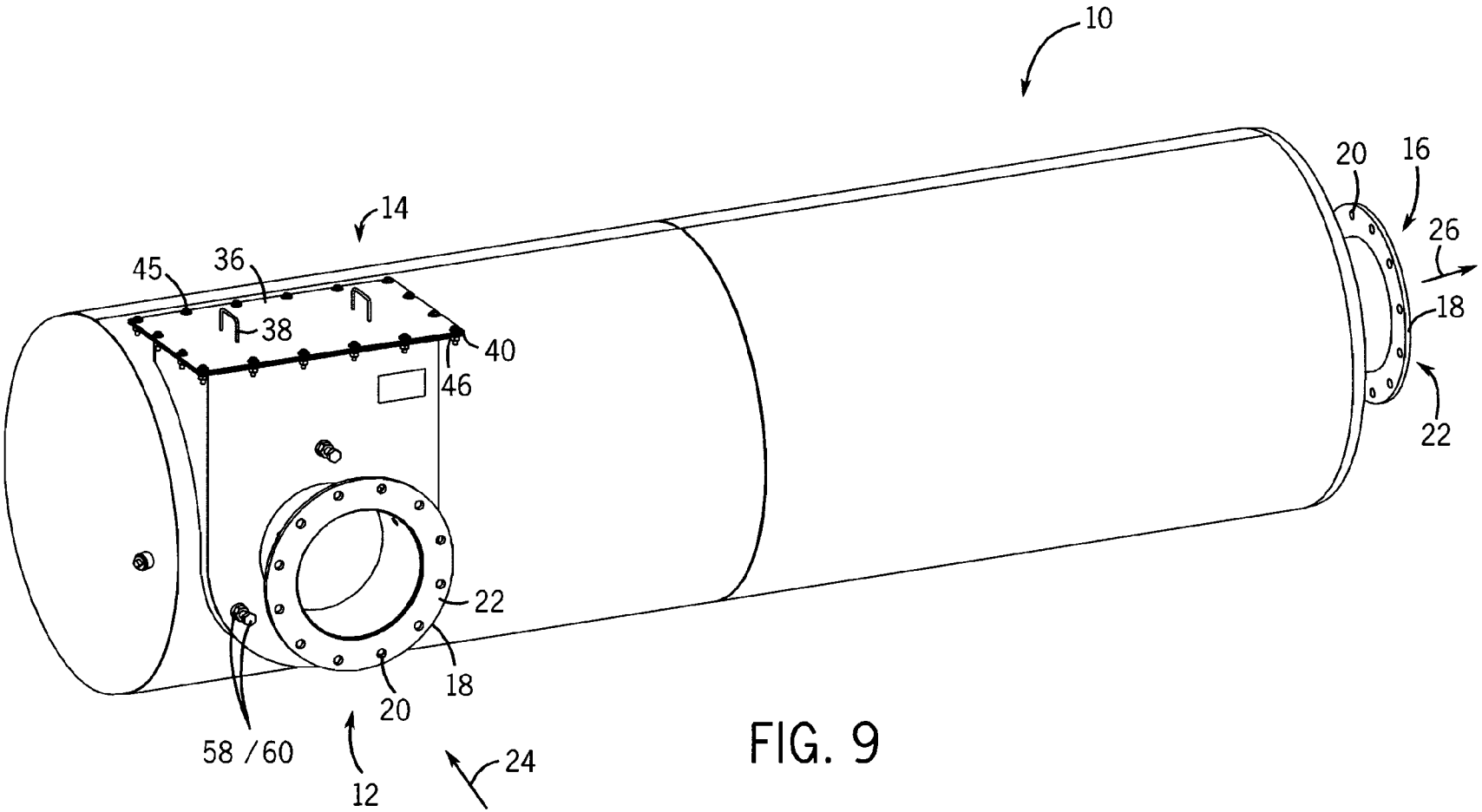
FIG. 9 is a perspective view of a catalyst housing in a side-in, end-out catalyst and silencer housing configuration.

FIG. 9 shows a side-in, end-out catalyst and silencer housing. The housing 14 is located at the inlet side of the silencer. In an alternative arrangement, housing 14 can be located elsewhere on the silencer, such as at the outlet side of the silencer.

Figure 10:
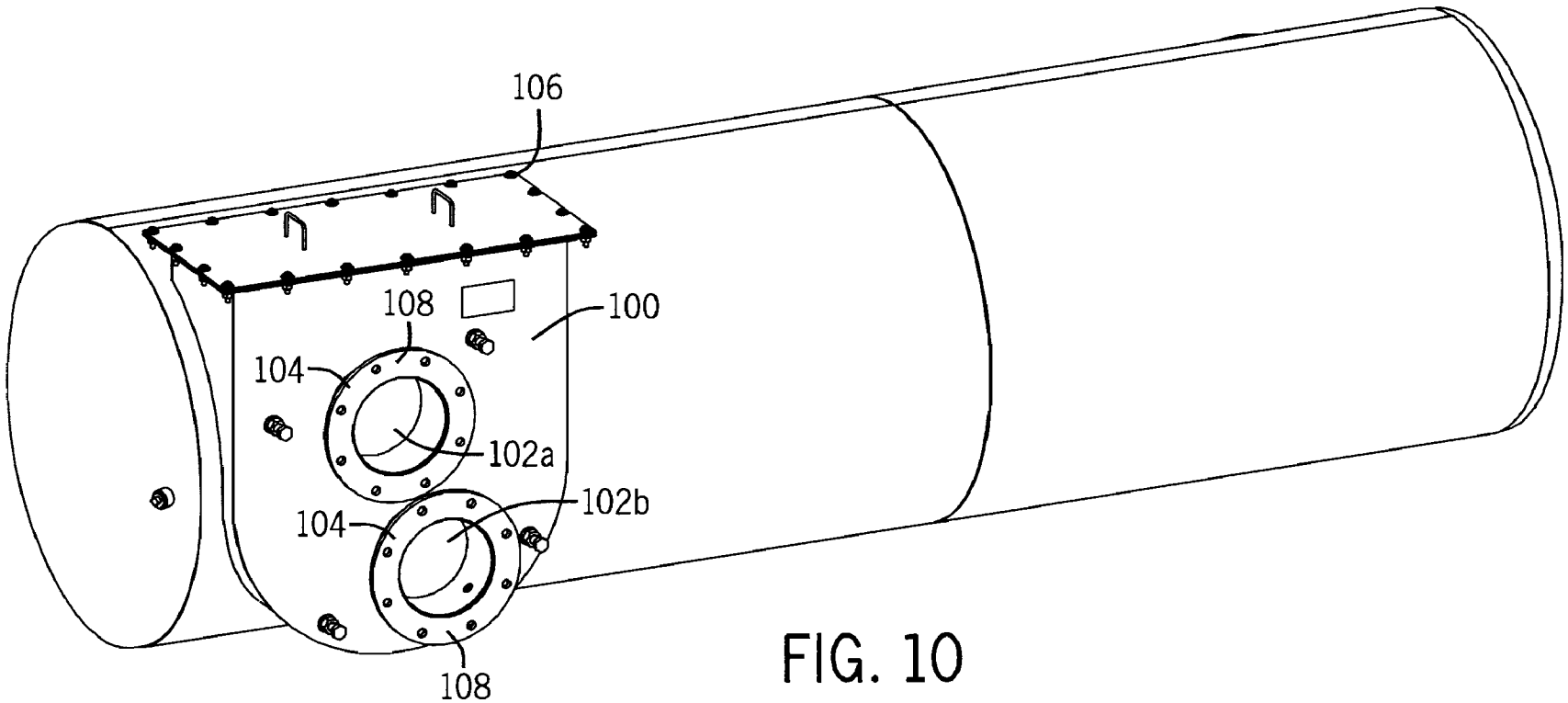
FIG. 10 is a perspective view of a catalyst housing in a side-in end-out catalyst and silencer housing configuration having a dual inlet.
Figure 11:
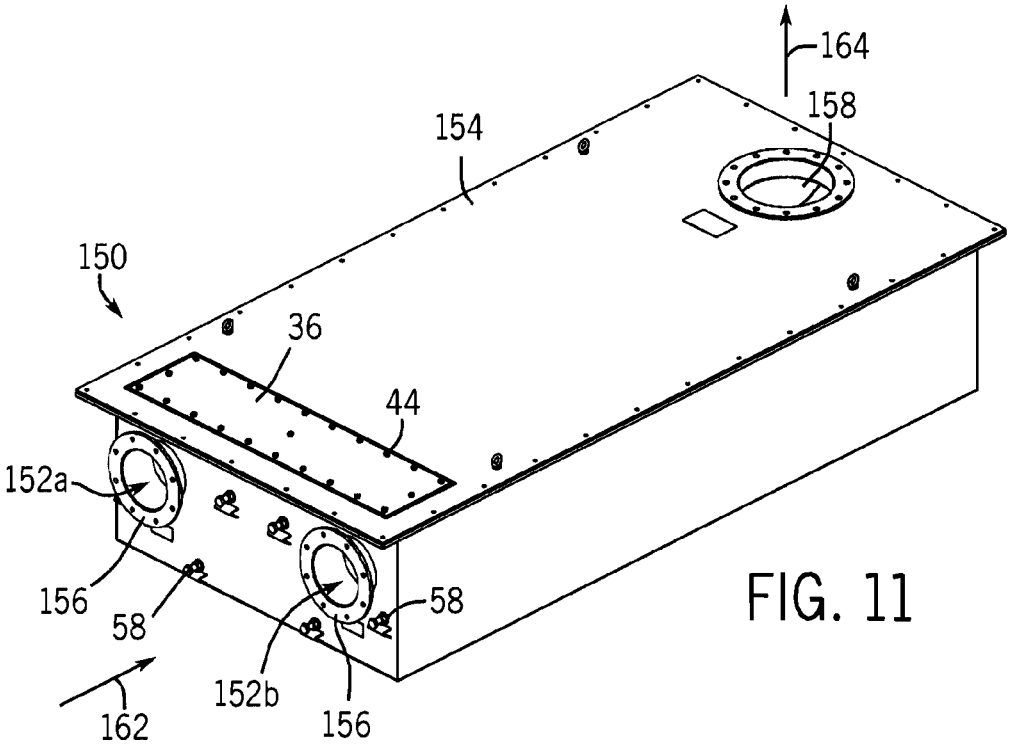
FIG. 11 is a perspective view of an end-in catalyst and silencer housing configuration having a dual inlet.

FIG. 10 shows a side-in catalyst and silencer housing. The housing 100 is located at the inlet side of the silencer and includes two inlets 102*a*, 102*b*. Each inlet 102*a*, 102*b* has a mating flange 104 for connection to an upstream source of exhaust gas. Each of the flanges 104 have a plurality of apertures 106 for receiving securing mechanisms, such as screws, for attachment to the upstream equipment. Flanges 104 both have outer sealing faces 108 for sealing with said equipment. Each of the inlets 102*a*, 102*b* are shown as cylindrical tubes, however any other shape suitable for conveying exhaust gas from upstream to downstream along the direction of arrow 110 can suffice. The inlets 102*a*, 102*b* can each include sensor ports, as shown and described above regarding the embodiment of FIG. 1. The body 14 of the housing 100 is otherwise the same as the body 14 depicted in FIGS. 1-7.

Figure 12:
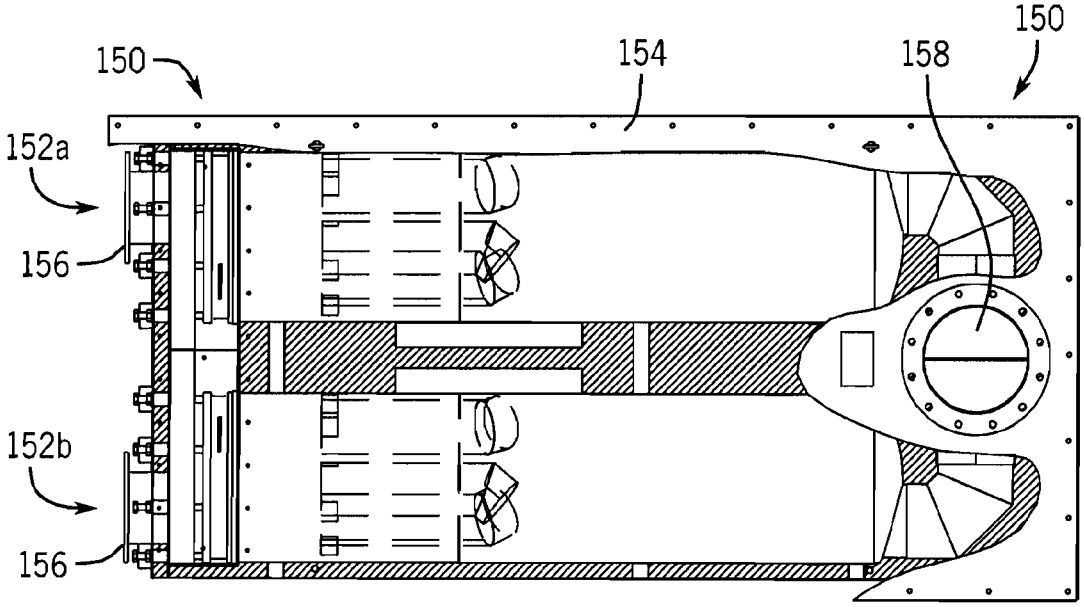
FIG. 12 is a top sectional view showing the catalyst housing of FIG. 11.

FIGS. 11-14 show another example of an end-in catalyst and silencer housing 150. The housing 150 includes dual inlets 152*a*, 152*b* located at the inlet side of the silencer 154. The inlets 152*a*, 152*b* have mating flanges 156 for connection to upstream sources of exhaust gas and for conveying said exhaust gas into the inlet side of the silencer 154 and onto the silencer outlet 158. Referring to FIG. 12, the silencer includes conventional spark arresting features and carbon drainage features 160. These structures will be understood by one skilled in the art and are not further described herein. The silencer outlet 158 is directed perpendicularly with respect to the inlets 152*a*, 152*b*.

Figure 13:
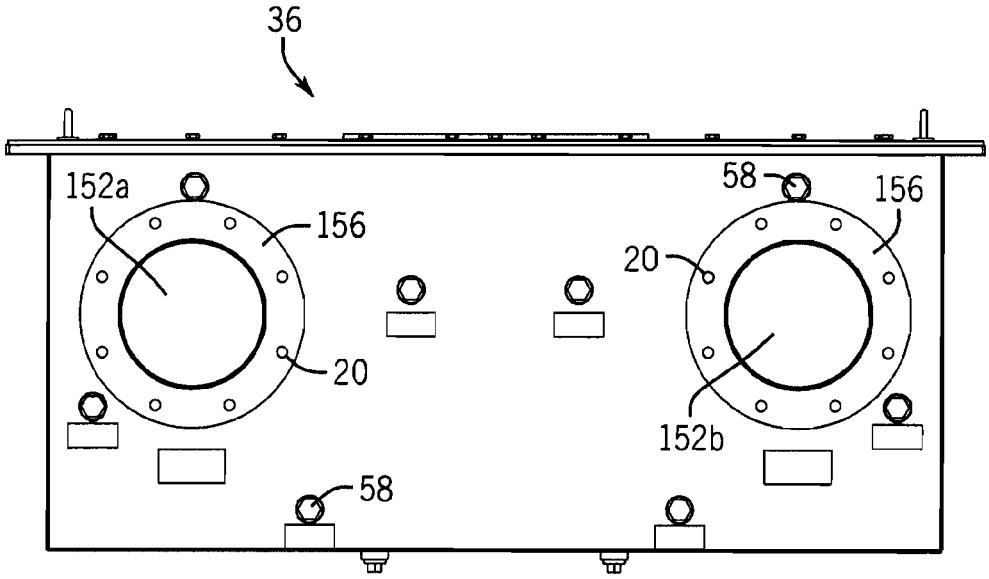
FIG. 13 is an end view showing the catalyst housing of FIG. 11.
Figure 14:
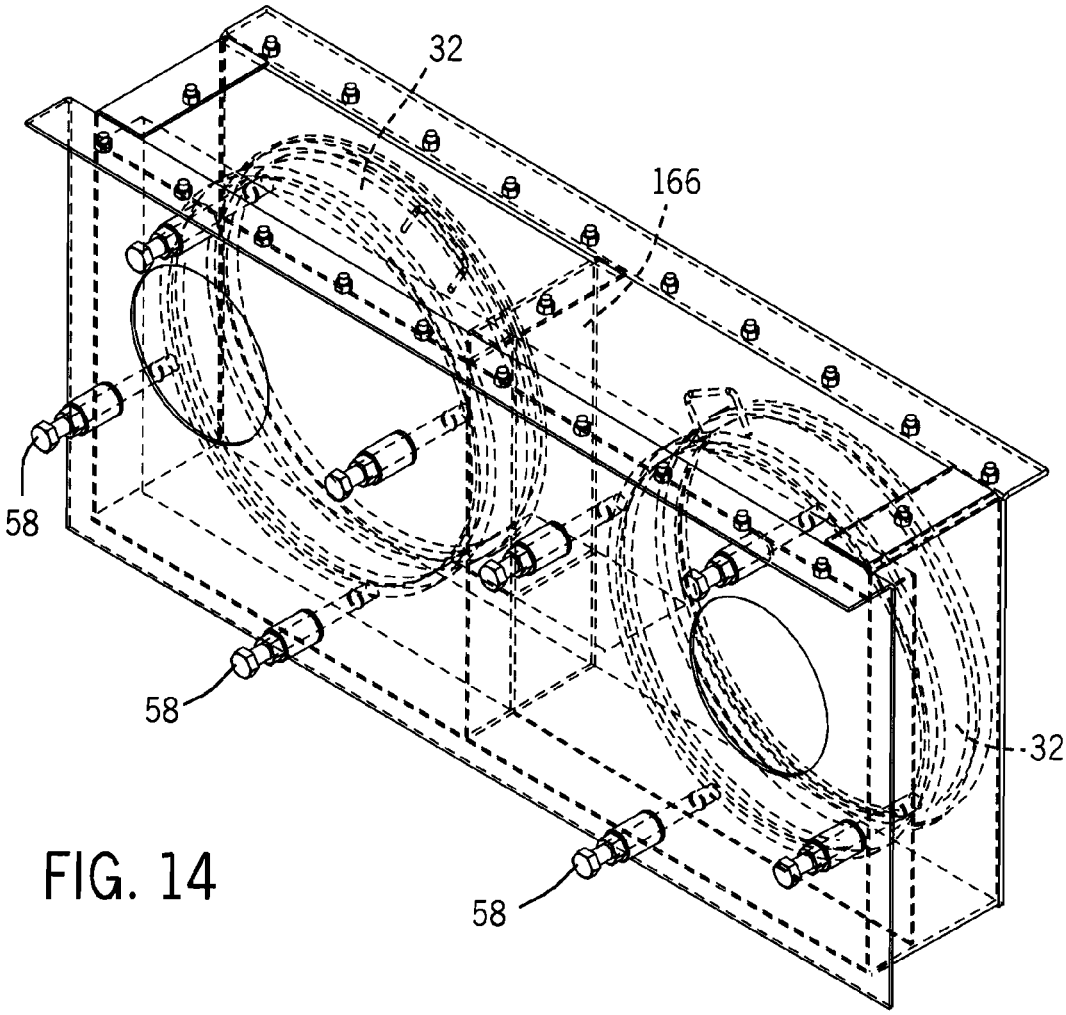
FIG. 14 is a perspective, phantomed view of the catalyst housing of inlet structure for the catalyst housing of FIG. 11.

Referring to FIGS. 13 and 14, the inlets 152*a*, 152*b* are shown as cylindrical tubes, however, any other shape suitable for conveying exhaust gas from upstream to downstream along the direction of arrows 162, 164 can suffice. Also, as described above in the embodiment regarding FIG. 1, the inlets 152*a*, 152*b* can include sensor ports for conventional temperature sensors, back pressure sensors, oxygen sensors, and or the like for measuring characteristics of inlet exhaust gas and outlet exhaust gas.

The embodiments shown in FIGS. 11-14 generally includes two housing structures, such as described above with reference to FIGS. 1-7 in side by side orientation and separated by a plate 166. Reference characters corresponding to structures shown in FIG. 1 are used to refer to structure in FIGS. 11-14. The overall housing structure and access door are elongated relative to the embodiment shown in FIGS. 1-7 due to the side by side orientation of the inlets 152*a*, 152*b* and the side by side orientation of the catalysts 32, 34 respectively. Otherwise, the structure and function described above in reference to FIGS. 1-7 applies equally to the embodiments shown in FIGS. 11-14.

What is claimed is:

1. A catalyst housing conveying exhaust gas from upstream to downstream, the catalyst housing comprising:

an exhaust gas inlet receiving a flow of exhaust gases;

an exhaust gas outlet discharging the flow of exhaust gases;

a housing body disposed between the inlet and outlet and removably containing a first catalyst located downstream of the exhaust gas inlet and upstream of the exhaust gas outlet;

an access door providing access to the first catalyst in the housing body, the access door being attached to the housing body and movable between a closed, sealed position and an open, unsealed position;

a sleeve on the first catalyst and first and second pressure rings on the sleeve; and at least one retention bolt having a distal end abutting the first ring, wherein as the retention bolt is torqued with respect to the housing body, axial force is applied to the first ring and then to the sleeve and then to the second ring to seal the first catalyst in the housing.

2. The catalyst housing according to claim 1, further comprising a sensor port and sensor located at the inlet for measuring at least one characteristic of inlet exhaust gas.

3. The catalyst housing according to claim 1, further comprising a sensor port and sensor located at the outlet for measuring at least one characteristic of outlet exhaust gas.

4. The catalyst housing according to claim 1, wherein the first catalyst is circular in cross-section.

5. The catalyst housing according to claim 1, further comprising a dispersion device disposed in the housing and located upstream of the first catalyst.

6. The catalyst housing according to claim 5, wherein the dispersion device comprises a perforated plate through which exhaust gas flows.

7. The catalyst housing according to claim 1, wherein the housing body comprises a flange surface and wherein the access door is removably attached to the flange surface.

8. The catalyst housing according to claim 7, wherein the access door and flange surface each have a series of slots that are aligned when the access door is properly mated with the flange surface, and further comprising a series of bolt connections removably connecting the access door and flange surface together.

9. The catalyst housing according to claim 8, further comprising a gasket seal sandwiched between the access door and flange surface to prevent exhaust gas escape from inside the housing body.

10. The catalyst housing according to claim 1, further comprising a second catalyst disposed in the housing body downstream of the first catalyst, and further comprising a sleeve on the second catalyst and outwardly extending first and second pressure rings on the sleeve, wherein the first and second rings on the sleeve of the first catalyst align with the first and second rings on the sleeve of the second catalyst when the first and second catalysts are disposed in the housing body.

11. The catalyst housing according to claim 10, wherein as the retention bolt is torqued down on the housing body via the threaded connection, axial force is applied to the first ring, sleeve and second ring of the first catalyst, and then onto the first ring, sleeve and second ring of the second catalyst, and then onto a sealing surface on the housing body, thus promoting sealing between the respective first and second rings of the first and second catalysts and retention of the first and second catalysts in the housing body.

12. The catalyst housing according to claim 1, further comprising a spacer disposed in the housing body downstream of the dispersion device, and further comprising outwardly extending first and second pressure rings on the spacer, wherein the first and second rings on the sleeve of the first catalyst align with the first and second rings on the spacer when the first catalyst and spacer are disposed in the housing body.

13. The catalyst housing according to claim 12, wherein as the retention bolt is torqued down on the housing body via the threaded connection, axial force is applied to the first ring, sleeve and second ring of the first catalyst, and then onto the first ring and second ring of the spacer and then onto a sealing surface on the housing body, thus promoting sealing between the respective first and second rings of the first catalyst and spacer and retention of the first catalyst and spacer in the housing body.

14. The catalyst housing according to claim 1, further comprising a filter element disposed in the housing body downstream of the dispersion device, and further comprising outwardly extending first and second pressure rings on the filter element, wherein the first and second rings on the sleeve of the first catalyst align with the first and second rings on the filter element when the first catalyst and spacer are disposed in the housing body.

15. The catalyst housing according to claim 14, wherein as the retention bolt is torqued down on the housing body via the threaded connection, axial force is applied to the first ring, sleeve and second ring of the first catalyst, and then onto the first ring and second ring of the filter element and then onto a sealing surface on the housing body, thus promoting sealing between the respective first and second rings of the first catalyst and filter element and retention of the first catalyst and filter element in the housing body.

16. The catalyst housing according to claim 1, further comprising a plurality of ribs extending axially inside the housing body for aligning the first catalyst in the housing body between the inlet and outlet.

17. The catalyst housing according to claim 1, comprising a silencer housing disposed between the inlet and outlet.

18. The catalyst housing according to claim 17, wherein the silencer is housed in an end-in, end-out silencer housing.

19. The catalyst housing according to claim 17, wherein the silencer is housed in a side-in, end-out silencer housing.

20. The catalyst housing according to claim 1, wherein said exhaust gas inlet comprises two inlet passages.

21. The catalyst housing according to claim 1, comprising insulation disposed in the housing.

22. The catalyst housing according to claim 1, wherein the at least one retention bolt is coupled to the housing body via a threaded connection, and is torqued with respect to the housing body via the threaded connection.

23. The catalyst housing according to claim 22, wherein the at least one retention bolt extends through the housing body.

* * * * *